United States Patent [19]

Shambaugh et al.

[11] 4,402,567

[45] Sep. 6, 1983

[54] TERMINAL ASSEMBLY

[75] Inventors: John S. Shambaugh, Holliston; Robert G. Yetman, Carlisle, both of Mass.

[73] Assignee: GTE Products Corporation, Stamford, Conn.

[21] Appl. No.: 271,497

[22] Filed: Jun. 8, 1981

[51] Int. Cl.[3] ..... H01R 9/00; H01R 13/64

[52] U.S. Cl. ..... 339/198 J; 339/184 M

[58] Field of Search ..... 339/36, 39, 184 R, 184 M, 339/198 R, 198 E, 198 J, 198 K

[56] References Cited

U.S. PATENT DOCUMENTS

| | | | |
|---|---|---|---|
| 1,023,326 | 4/1912 | Murray | 339/198 J |
| 2,415,602 | 2/1947 | Monaco | 339/36 |
| 4,099,826 | 7/1978 | Mazzeo et al. | 339/198 R |

FOREIGN PATENT DOCUMENTS

| | | | |
|---|---|---|---|
| 106197 | 12/1938 | Australia | 339/184 R |
| 519783 | 4/1940 | United Kingdom | 339/184 |

*Primary Examiner*—Joseph H. McGlynn
*Assistant Examiner*—Paula Austin
*Attorney, Agent, or Firm*—David M. Keay; Peter Xiarhos

[57] ABSTRACT

A terminal assembly is provided for use with an electric storage battery for making electrical output connections from the battery. The terminal assembly includes a pair of end sections to which electrical cables are connected by passing bolts through openings in lugs of the cables and advancing the bolts into corresponding threaded openings provided in metal insert terminals disposed within insulative body portions of the end sections. The end sections are constructed so that the bolts can be advanced and tightened within their associated openings only by a socket wrench, and the bolt sizes, lug sizes and openings in the lugs are selected to prevent and minimize misconnection of the cables. A separator member interposed between the end sections minimizes the possibility of the bolts being shorted together by a metal tool.

4 Claims, 6 Drawing Figures

TERMINAL ASSEMBLY

The invention herein described was made in the course of a contract with the Department of the Air Force.

BACKGROUND OF THE INVENTION

The present invention relates to a terminal assembly and, more particularly, to a terminal assembly by which external electrical output connections can be made from a power source such as an electric storage battery.

It is often necessary or desirable in applications utilizing electric storage batteries, especially very high-power, high-current drain storage batteries, to make electrical output connections from terminals associated with these batteries to apparatus to be powered by the batteries. In making these electrical connections, it is very important that the electrical terminals to which the electrical connections are to be made not be misconnected or shorted together or, in the case of an electrically live metal battery housing, shorted to the housing. Failure to make the proper electrical connections or the inadvertent creation of short circuit conditions can result in potential injury to personnel, damage to equipment, or fire. The exercise of great care and attentiveness on the part of the workperson in making electrical connections and in the use of tools, especially metal tools which might lead to the occurrence of short circuit conditions, are thus extremely important.

BRIEF SUMMARY OF THE INVENTION

In accordance with the present invention, a terminal assembly is provided which eliminates or minimizes the types of problems as described hereinabove. The terminal assembly in accordance with the invention is arranged to be connected with a first electrical cable having a lug of a first size and an opening therein of a first size and a second cable having a lug of a second size larger than the lug of the first cable and an opening therein of a second size larger than the opening in the lug of the first cable.

The terminal assembly of the invention includes first and second spaced-apart sections adapted to be connected with the first and second cables, respectively. The first section generally comprises a main body portion, a metal insert terminal, and a metal fastener. The main body portion of the first section is of an electrically insulative material and has a cavity for the receipt therein of the lug of the first cable. The main body portion further has a passageway extending into the cavity, this passageway having a width at least equal to the width of the lug of the first cable but less than the width of the lug of the second cable. The above-mentioned metal insert terminal is disposed within the main body portion and has a fastener-receiving opening adjacent to the cavity in the main body portion. The metal fastener has a portion of a size permitting insertion and passage thereof into the opening in the lug of the first cable and is arranged to be advanced into and along the fastener-receiving opening in the metal insert terminal for securing the first cable with its associated lug to the metal insert terminal.

The second section of the terminal assembly also includes a main body portion, a metal insert terminal and a metal fastener. The main body portion of the second section is also of an electrically insulative material and has a cavity for the receipt therein of the lug of the second cable. The main body portion further has a passageway extending into the cavity, this passageway having a width at least equal to the width of the lug of the second cable. The metal insert terminal of the second section is disposed within the main body portion and has a fastener-receiving opening adjacent to the cavity in the main body portion. The metal fastener of the second section has a portion of a size permitting insertion and passage thereof into the opening in the lug of the second cable but larger than the opening in the lug of the first cable. The fastener is arranged to be advanced into and along the fastener-receiving opening in the metal insert terminal for securing the second cable with its associated lug to the metal insert terminal.

BRIEF DESCRIPTION OF THE DRAWING

Various objects, features and advantages of a terminal assembly in accordance with the present invention will be apparent from a detailed discussion taken in conjunction with the accompanying drawing in which.

DETAILED DESCRIPTION OF THE INVENTION

Figure 1:
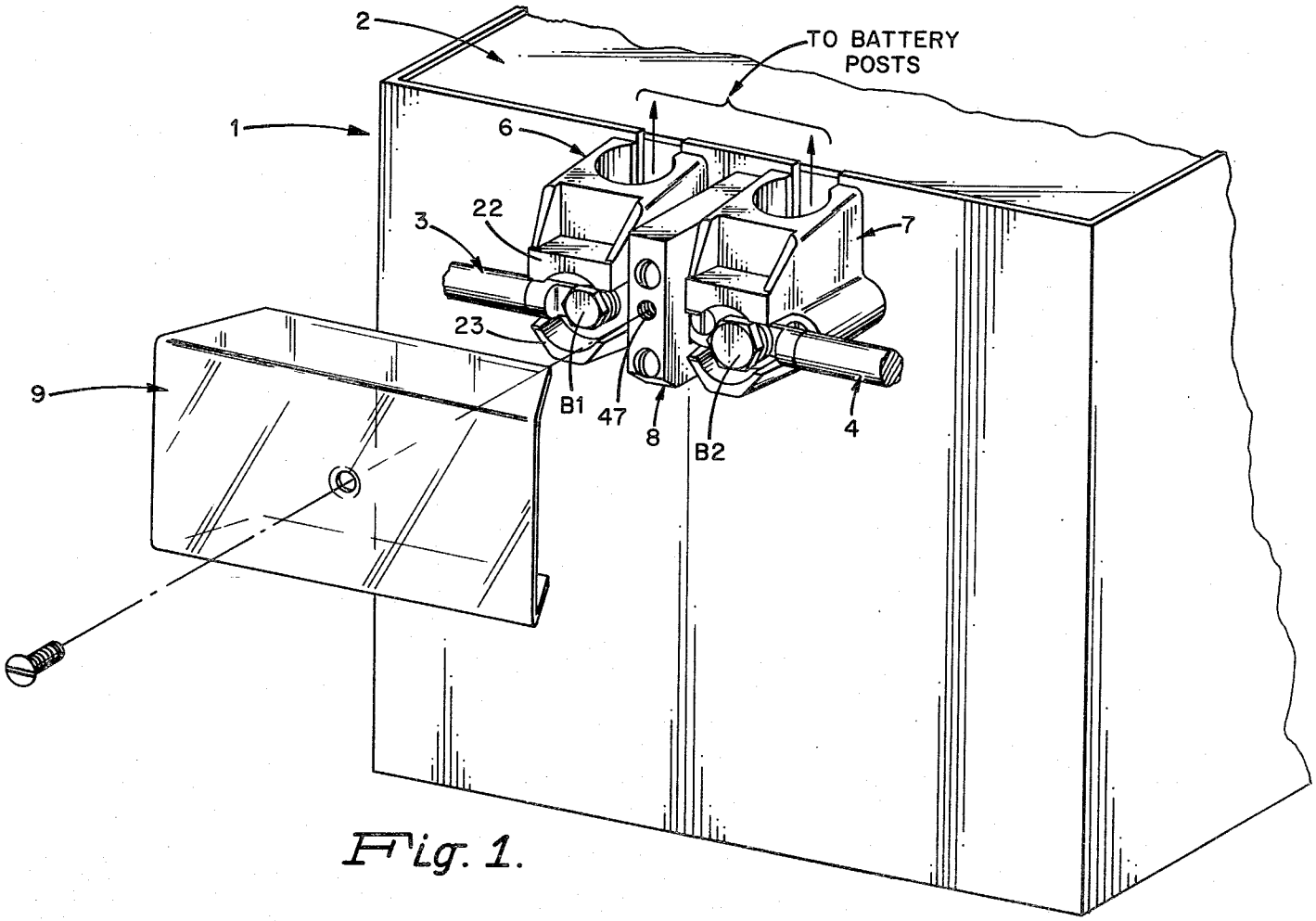
FIG. 1 illustrates a terminal assembly in accordance with the invention as employed in connection with an electric storage battery.

Referring now to FIG. 1, there is shown a terminal assembly 1 in accordance with the invention as employed in connection with an electric storage battery 2 for deriving voltages from the storage battery 2, specifically, by way of a pair of cables 3 and 4 connected to the terminal assembly 1. The voltages conducted by the cables 3 and 4 may be used by any suitable apparatus (not shown).

The terminal assembly 1 as shown in FIG. 1, and also in additional detail in FIGS. 2–6, generally comprises first and second spaced-apart end sections 6 and 7, respectively, a separator member 8 interposed between the end sections 6 and 7, and a cover member 9. The two end sections 6 and 7 are of similar form and construction with the exception that the end section 6, that is, the left end section as shown in FIG. 1, is arranged to be used with a first bolt B1 of a first size (e.g., $\frac{3}{8}$ inch diameter) slightly smaller than the size (e.g., $\frac{1}{2}$ inch diameter) of a second bolt B2 used by the end section 7, that is, the right end section as shown in FIG. 1. An indicated in FIG. 1, the cables 3 and 4 are arranged to be connected with the first and second end sections 6 and 7 by way of the aforementioned bolts B1 and B2. As will be discussed more fully hereinafter, the cables 3 and 4 are further arranged to have different sized lugs, shown at 10 and 11 in FIG. 2. In addition, the lugs themselves have different sized openings **10*a* and 11*a* for use with the different sized bolts B1 and B2 for preventing misconnection of the cables 3 and 4 with the bolts B1 and B2**.

Figure 3:
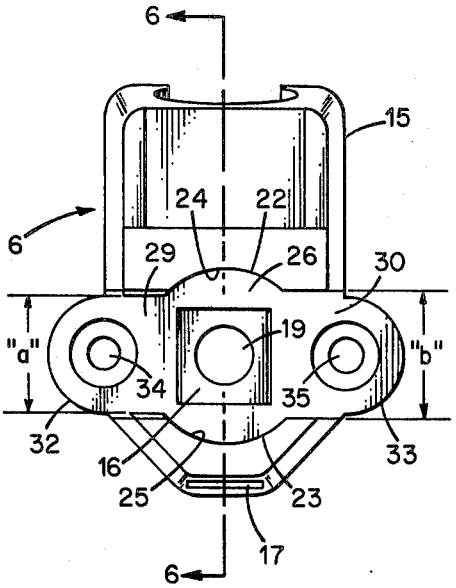
FIGS. 3 and 4 are top and bottom views, respectively, of one of a pair of end sections employed by the terminal assembly in accordance with the invention.
Figure 4:
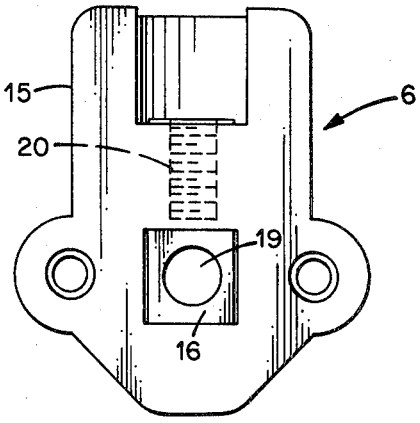
Figure 6:
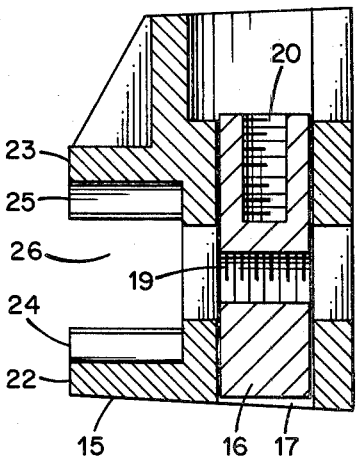
FIG. 6 is a cross-sectional view, taken along a line 6—6 in FIG. 3, illustrating a metal insert terminal employed by one of the pair of end sections of the terminal assembly in accordance with the invention.

One of the end sections 6 and 7, specifically, the left end section 6, is shown in various additional views in FIGS. 3, 4 and 6. As shown in these figures, the end section 6 generally comprises a main body portion 15 and a metal insert terminal 16 (see FIG. 6) inserted within an opening 17 provided within the main body portion 15, as shown most clearly in FIG. 6. The insert terminal 16 has first and second threaded openings 19 and 20 at right angles to each other, as also shown most clearly in FIG. 6. The main body portion 15 of the end section 6 is of a unitary construction, for example, of a molded plastic material such as a glass-filled (30%) phenylene oxide, and has a pair of opposed arcuate parts 22 and 23 with curved surfaces 24 and 25, respectively, defining a deep cavity 26. The bolt B1 is inserted by way of the cavity 26 into the opening 19 of the insert terminal 16 for attaching the cable 3 to the end section 6. The parts 22 and 23 further define first and second passageways 29 and 30, shown most clearly in FIG. 3, leading into the cavity 26. For reasons to be explained more fully hereinafter, the passageway 29 is made to have a width, shown at "a" in FIG. 3, slightly less than the width, shown at "b" in FIG. 3, of the other passageway 30.

The end section 6 as described hereinabove further includes a pair of bosses 32 and 33 having openings 34 and 35 therein by which the end section may be physically attached, as by the use of threaded bolts (not shown), to the housing of the storage battery 2. The end section 6 may be electrically connected to the storage battery 2 by means of a cable (not shown) attached to a post of the battery and to a bolt (not shown) inserted into the insert terminal 16 by way of the opening 20. The insert terminal 16 may be of any suitable electrically-conductive material, for example, of copper.

Figure 2:
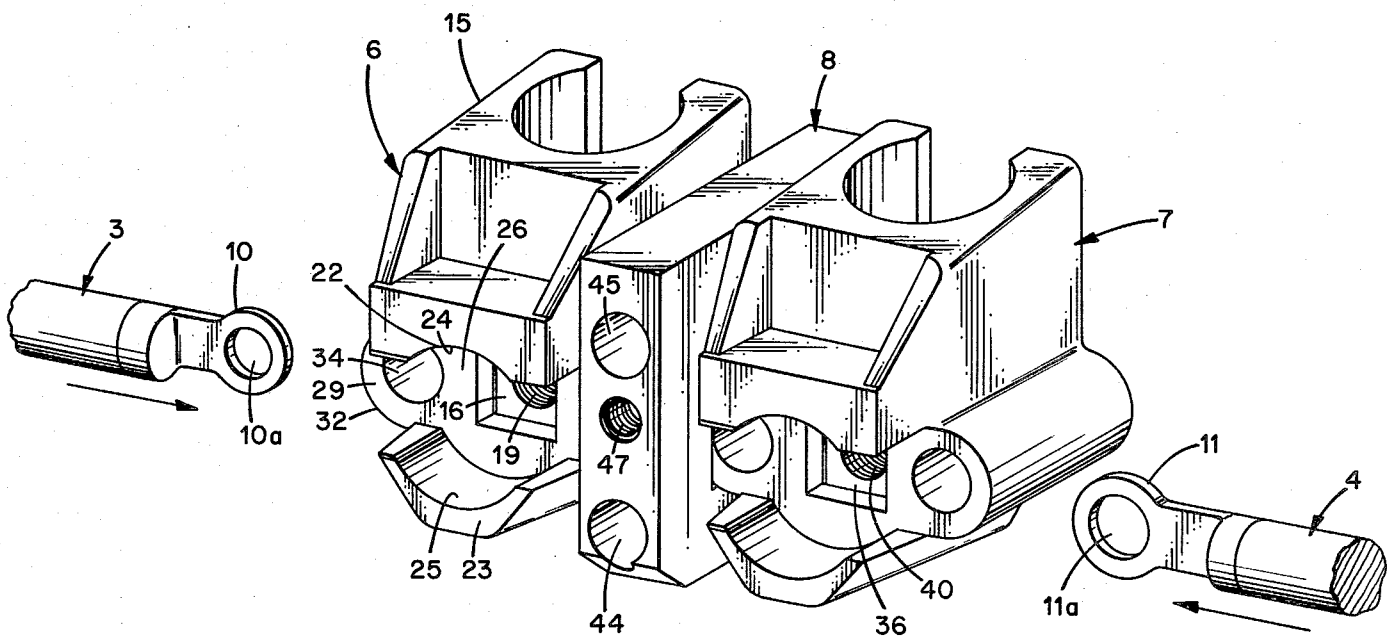
FIG. 2 is an enlarged perspective view illustrating the components of the terminal assembly in accordance with the invention.

Although not specifically described in detail hereinabove, the end section 7 is identical to the end section 6 with the exception that the insert terminal for the end section 7, shown at 36 in FIG. 2, has a threaded opening 40 therein of a size (e.g., ½ inch) to accommodate the specific size of the bolt B2.

Figure 5:
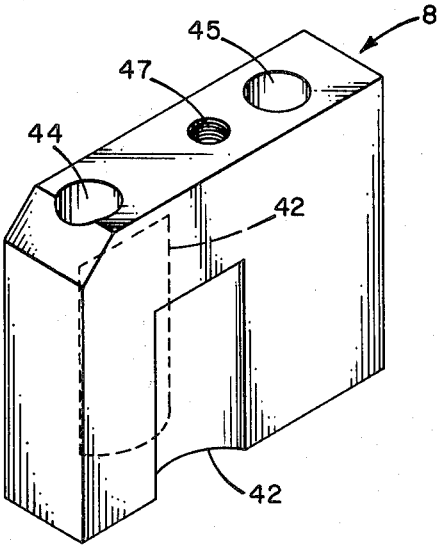
FIG. 5 is a perspective view of a separator member employed between the pair of end sections of the terminal assembly in accordance with the invention.

The previously mentioned separator member 8 interposed between the aforedescribed end sections 6 and 7 is of a generally rectangular configuration as indicated in FIG. 5 and has a height slightly greater than the heights of the end sections 6 and 7 for reducing the possibility of a tool, particularly a metal tool, being bridged directly across and shorting the two bolts B1 and B2. The separator member 8, which may be of the same material as the main body portions of the two end sections 6 and 7, further has a pair of recesses 42 into which the adjacent inner ones of the bosses of the end sections are positioned, and a pair of openings 44 and 45 by which the separator member 8 may be attached, as by threaded bolts (not shown), to the housing of the battery 2.

Electrical connections to the terminal assembly 1, specifically, the connection of the cables 3 and 4 to the individual end sections 6 and 7 and associated bolts B1 and B2, are accomplished in the following manner. The cable 3 having the small lug 10 is moved in a horizontal direction through the left, smaller passageway 29 of the end section 6 until the lug 10 of the cable 3 is generally above the threaded opening 19 in the insert terminal 16. The bolt B1 is then inserted through the opening **10*a* (e.g., ¾ inch) in the lug 10 and threaded into the opening 19 in the insert terminal 16. By virtue of the deep circular cavity 26 formed in the end section 6 by the parts 22 and 23, for example, a diameter of 1.2 inch and depth of 0.8 inch, the only tool that can effectively be used for advancing and tightening the bolt B1 is a socket wrench, either a deep socket wrench or a standard socket wrench with an extension. The use of either type of tool serves to prevent a workperson from bumping the tool against a possibly electrically-live metal housing of the battery 2 and causing personal injury, damage to the battery 2, or fire. It will be noted that it is possible for the cable 3 as discussed hereinabove to be inserted by way of the right-hand, larger passageway of the end section 7 into the deep cavity associated with that end section; however, the opening 10*a* in the lug 10 is too small to receive the bolt B2. Thus, it is not possible to misconnect the cable 3 to the end section 7**.

In the same manner as described hereinabove, the cable 4 is attached to the end section 7 by moving the cable 4 horizontally through the right-hand, larger passageway of the end section 7 until the lug 11, which has a larger opening **11*a* than in the lug 10, is positioned above the threaded opening 40 in the insert terminal 36. The bolt B2 is then inserted through the opening 11*a* in the lug 11 and threaded into the opening 40 in the insert terminal 36, again using a long socket wrench or a standard socket wrench with an extension. Because the separator member 8 acts as a tall partition or barrier between the two end sections 6 and 7 and because of the deep cavity associated with the end section 7, it is extremely unlikely that the tool used to advance and tighten the bolt B2 within the opening 40 will short against the other bolt B1 or the housing of the battery 2. Typically, the handle of the wrench will be about 2 inches above the housing of the battery 2. It will also be noted that it is not easy to connect the cable 4 to the bolt B1 of the left end section 6 due to the general orientation of the cable 4, its general stiffness, the presence of the tall separator 8 intermediate to the end sections 6 and 7 and serving as a barrier, and also because the lug 11 is larger than the width "a" of the passageway 29 of the end section 6. A misconnection of the cable 4 to the bolt B1** could only occur therefore by intention and the misconnection in such a case would be obvious to the workperson.

Once both cables 3 and 4 have been secured to their respective end sections 6 and 7 as described hereinabove, the entire terminal assembly 1 may be covered by the aforementioned cover member 9. This operation can be accomplished by simply securing the cover 9, which may be of a clear insulative plastic material, to the separator member 8 by means of a bolt (not shown) inserted through an opening in the cover 9 as shown in FIG. 1 and threaded into a threaded opening 47 provided in the separator member 8.

While there has been described what is considered to be a preferred embodiment of the invention, it will be apparent to those skilled in the art that various changes and modifications may be made therein without departing from the invention as called for in the appended claims.

What is claimed is:

1. A terminal assembly arranged to be connected with first and second electrical cables, said first cable having a lug of a first size and a opening therein of a first size and said second cable having a lug of a second size larger than the lug of the first cable and an opening therein of a second size larger than the opening in the lug of the first cable, said terminal assembly comprising:

first and second spaced-apart sections adapted to be connected with the first and second cables, respectively;

said first section comprising:

a first main body portion of an electrically insulative material having a cavity for the receipt therein of the lug of a cable, having a first passageway extending into the cavity, said first passageway having a width at least equal to the width of the lug of the first cable but less than the width of the lug of the second cable, and having a second passageway extending into the cavity, said second passageway having a width at least equal to the width of the lug of the second cable;

a first metal insert terminal disposed within the first main body portion and having a fastener-receiving opening adjacent to the cavity in the first main body portion; and a first metal fastener having a portion of a size permitting insertion and passage thereof into the opening in the lug of the first cable and arranged to be advanced into and along the fastener-receiving opening in the first metal insert terminal for securing the first cable with its associated lug to the first metal insert terminal; and said second section comprising:

a second main body portion of an electrically insulative material and of identical form and construction as said first main body portion;

a second metal insert terminal disposed within the second main body portion and having a fastener-receiving opening adjacent to the cavity in the second main body portion; and a second metal fastener having a portion of a size permitting insertion and passage thereof into the opening in the lug of the second cable but larger than the opening in the lug of the first cable, said second fastener being arranged to be advanced into and along the fastener-receiving opening in the second metal insert terminal for securing the second cable with its associated lug to the second metal insert terminal;

wherein:

each of the main body portion of the first and second sections includes arcuate portions defining a generally circular cavity therein of a height and size whereby the associated metal fastener can be effectively advanced into and along the corresponding metal insert terminal only by a socket wrench;

said first passageway in each of said main body portions extends into said cavity from one side thereof; and said second passageway in each of said main body portions extends into said cavity from the opposite side thereof;

further comprising:

a separator member intermediate to the first and second sections and having a height greater than the heights of the first and second sections for minimizing the possibility of the metal fasteners being shorted together by a metal object or tool during and following the advancement of the metal fasteners into their respective metal insert terminals, said separator member further serving to block access to the cavity in said first main body portion by way of said second passageway therein and serving to block access to the cavity in said second main body portion by way of said first passageway therein;

and wherein:

each of said main body portions has a first boss extending from said one side and a second boss extending from said opposite side;

said separator member having a first recess for positioning said second boss of the first main body portion and a second recess for positioning said first boss of the second main body portion.

2. A terminal assembly in accordance with claim 1 wherein:

each of the metal insert terminals includes an additional fastener-receiving opening therein for the receipt and advancement therein of a corresponding metal fastener.

3. A terminal assembly in accordance with claim 2 further comprising:

a cover member covering the first and second sections having the cables secured therewith and the separator member intermediate to the first and second sections.

4. A terminal assembly in accordance with claim 3 wherein:

the opening in the lug of the first cable and the portion of the metal fastener advanced into and along the fastener-receiving opening of the first insert terminal of the first section are of like diameter; and the opening in the lug of the second cable and the portion of the metal fastener advanced into and along the fastener-receiving opening of the second insert terminal of the second section are of like diameter.

* * * * *